US006356013B1

(12) United States Patent
Pong et al.

(10) Patent No.: US 6,356,013 B1
(45) Date of Patent: Mar. 12, 2002

(54) WALL ASSEMBLY AND METHOD FOR ATTACHING WALLS FOR FLAT PANEL DISPLAY

(75) Inventors: Chungdee Pong, Cupertino; John D. Porter, Berkeley; Theodore S. Fahlen, San Jose; Christopher J. Curtin, San Jose; Robert G. Neimeyer, San Jose; Paul N. Ludwig, Livermore, all of CA (US)

(73) Assignee: Candescent Intellectual Property Services, Inc., San Jose, CA (US)

( * ) Notice: Subject to any disclaimer, the term of this patent is extended or adjusted under 35 U.S.C. 154(b) by 0 days.

(21) Appl. No.: 09/397,791

(22) Filed: Sep. 16, 1999

Related U.S. Application Data

(62) Division of application No. 08/887,227, filed on Jul. 2, 1997, now Pat. No. 5,829,394.

(51) Int. Cl.[7] ..... H01J 29/18
(52) U.S. Cl. ..... 313/495; 313/292; 313/422
(58) Field of Search ..... 313/495, 497, 313/292, 496, 309, 336, 351, 249, 252, 253, 256, 257, 258, 262, 422

(56) References Cited

U.S. PATENT DOCUMENTS 4,835,039 A 5/1989 Barringer et al. ..... 428/210
5,543,683 A * 8/1996 Haven et al. ..... 313/292 X
5,578,899 A * 11/1996 Haven et al. ..... 313/422
5,589,731 A * 12/1996 Fahlen et al. ..... 313/495
5,674,634 A 10/1997 Wang et al. ..... 428/688

FOREIGN PATENT DOCUMENTS

WO WO99/36937 7/1999 ..... H01J/31/12

* cited by examiner

*Primary Examiner*—Ashok Patel
(74) *Attorney, Agent, or Firm*—Wagner, Murabito & Hao LLP

(57) ABSTRACT

A flat panel display and a method for forming a flat panel display. In one embodiment, the flat panel display includes a wall which is held in place by a structure formed either on the faceplate or on the backplate. In one embodiment the supporting structure is formed by two adjacent walls that form a slot which mechanically restrains the wall. In another embodiment a slot is formed within the faceplate and the walls of the slot mechanically restrain the wall. In one embodiment wall segments are inserted into supporting structures that mechanically restrain each wall segment. In another embodiment a UV curable or a heat curable adhesive is used to maintain walls in their proper alignment and position. In yet another embodiment a conductive material is melted so as to bond conductive lines located on the wall and conductive lines located on the faceplate. This bond electrically connects the conductive lines located on the wall and the conductive lines located on the faceplate and maintains the wall in the proper alignment. The present invention eliminates the need for feet which attach to individual walls for maintaining the walls in the proper alignment.

1 Claim, 18 Drawing Sheets

WALL ASSEMBLY AND METHOD FOR ATTACHING WALLS FOR FLAT PANEL DISPLAY

This is a divisional of application Ser. No. 08/887,227 filed on Jul. 02, 1997 now U.S. Pat No. 5,829,394.

TECHNICAL FIELD

The present claimed invention relates to the field of flat panel displays. More specifically, the present claimed invention relates to a flat panel display and methods for forming a flat panel display having walls that extend through the active area of the display.

BACKGROUND ART

A Cathode Ray Tube (CRT) display generally provides the best brightness, highest contrast, best color quality and largest viewing angle of prior art computer displays. CRT displays typically use a layer of phosphor which is deposited on a thin glass faceplate. These CRTs generate a picture by using one to three electron beams which generate high energy electrons that are scanned across the phosphor in a raster pattern. The phosphor converts the electron energy into visible light so as to form the desired picture. However, prior art CRT displays are large and bulky due to the large vacuum envelopes that enclose the cathode and extend from the cathode to the faceplate of the display. Therefore, typically, other types of display technologies such as active matrix liquid crystal display, plasma display and electroluminescent display technologies have been used in the past to form thin displays.

Recently, a thin flat panel display (FPD) has been developed which uses the same process for generating pictures as is used in CRT devices. These flat panel displays use a backplate including a matrix structure of rows and columns of electrodes. One such flat panel display is described in U.S. Pat. No. 5,541,473 which is incorporated herein by reference. Typically, the backplate is formed by depositing a cathode structure (electron emitting) on a glass plate. The cathode structure includes emitters that generate electrons. The backplate typically has an active area surface within which the cathode structure is deposited. Typically, the active area surface does not cover the entire surface of the glass plate, a thin strip is left around the edges of the glass plate. The thin strip is referred to as a border or a border region. Conductive traces extend through the border to allow for electrical connectivity to the active area surface. These traces are typically covered by a dielectric film as they extend across the border so as to prevent shorting.

Prior art flat panel displays include a thin glass faceplate (anode) having a layer of phosphor deposited over the surface of the faceplate. A conductive layer is deposited on the glass or on the phosphor. The faceplate is typically separated from the backplate by about 1 millimeter. The faceplate includes an active area surface within which the layer of phosphor is deposited. The faceplate also includes a border region. The border is a thin strip that extends from the active area surface to the edges of the glass plate. The faceplate is attached to the backplate using a glass sealing structure which does not contain phosphor. This sealing structure is typically formed by melting a glass frit in a high temperature heating step. This forms an enclosure which is pumped out so as to produce a vacuum between the active area surface of the backplate and the active area surface of the faceplate. Individual regions of the cathode are selectively activated to generate electrons which strike the phosphor so as to generate a display within the active area surface of the faceplate. These flat panel displays have all of the advantages of conventional CRTs but are much thinner.

In order to maximize the display area for any given size of flat panel display, it is important to minimize the amount of area of the faceplate and the backplate which is required as a border. Typically, traces extend through the border such that the traces extend outside of the area enclosed by the seal to allow for connection to input, output, and power utilities.

Ceramic walls or "spacers" are currently used in assembly to separate the faceplate and the backplate in thin cathode ray tube (TCRT) displays. One of the most critical aspects of making supports invisible in the display is the mechanical placement of the supports in the correct location. Once the display is sealed and becomes a vacuum envelope, atmospheric pressure creates a significant load on the walls. This load permanently captures the walls in the location where they were the moment before the display was introduced to atmospheric pressure in the sealing process. Since this capture is permanent, it is critical that the walls remain in the correct location and orientation from the time the supports are placed in the display until the seal process is finished.

Prior art methods for supporting walls use wall supports or "feet" attached to both ends of each wall so as to make each wall self standing and help maintain perpendicularity of the walls with respect to the anode and the cathode. Conventional wall feet must reside in the border and do not extend into the active area surface. Thus, prior art methods require that the border be of sufficient size to accommodate wall feet. It is further required that the walls be perpendicular to the cathode and the faceplate such that they do not interfere with electron emission and reception. In the event that a wall becomes misaligned or tilted, the wall deflects emitted electrons, interfering with the operation of the display so as to cause visible defects on the display. Other types of wall feet include ceramic frames that capture the walls between slots, ceramic feet attached to the ends of the walls, and metal or glass clips that are clamped to the ends of the walls. Each of theses types of feet are attached to each end of each wall.

The process of making long ceramic walls is expensive and time consuming. Much of this time and expense is due to the extensive processes required to attach wall feet to the ends of each wall. Ceramic wall feet are typically formed by making ceramic bars which are attached to opposite sides of ceramic wafer by a process referred to as caning. The wafers are then sliced so as to form individual walls. The numerous process steps for forming and attaching feet are expensive, they are difficult, they take up a significant amount of time, they lower throughput rates and they lower yield. The process of making walls for displays having widths of six inches or more is particularly expensive and time consuming since large wafers having a diameter of 6 inches or more must be handled. The handling of the large wafers requires an extensive amount of expensive capital equipment for each size of wafer to be used. Moreover, specialized equipment is required for each size of display to assure that the walls are properly placed. This specialized equipment is expensive and the requisite set-up time for forming different sized displays adds expense and time to the manufacturing process.

It is further beneficial to reduce the required width of the border. In so doing, more display area is obtained for a given size of glass. Since the feet reside in the border region, and since the feet must be maintained at a distance from the active area surface of the display due to the fact that the cane material used to attach the feet to the wall has properties that can cause arcing near high electric field regions, the feet require a significant amount of border region. What is needed is a method which will decrease or eliminate the amount of border allotted for wall feet. This would allow for a larger display area to be formed over a particular size of glass plate.

Another prior art method for alignment of walls includes the mechanical restraint of the walls by a fixture which maintains each wall in proper alignment and position until the wall is bonded to the faceplate in a high temperature process step. This has been done in the past by tacking of each wall on one side thereof using glass frit. Typically, temperatures in the range of 450 degrees centigrade are used to melt the frit. These thermal process steps are lengthy, they decrease throughput, and they stress the surfaces of the faceplate and the backplate. Moreover, the high heat causes the surfaces of the display assembly to outgass (primarily the polyimide surfaces on the faceplate and the backplate). Furthermore, this outgassing contaminates the emitter surface, resulting in reduced display performance.

As yet another drawback, flat panel display fabrication processes are expensive and the manufacturing process is time consuming due in large part to the number of complex steps required in the bonding process. Moreover, prior art bonding processes are performed at high temperatures, resulting in outgassing and heat generated defects. This decreases yield and increases overall manufacturing cost. In addition, the numerous process steps take up a significant amount of time so as to cause low throughput rates. Hence, the high temperature processes associated with conventional bonding methods damages the active area surface of the display.

Thus, a need exists for a wall which does not require that feet be manufactured and attached to both ends thereof. A further need exists for a wall alignment and placement method which does not require a large border and which does not reduce the available active area surface. A further need exists for a flat panel display and a method for forming a flat panel display which allows for standardization of the tooling such that different tooling is not required for each size of display. The present invention meets the above needs.

DISCLOSURE OF THE INVENTION

The present invention provides a flat panel display which is simpler than prior art flat panel displays and which is easier and less expensive to manufacture than prior art flat panel displays. The fabrication of the flat panel display of the present invention requires fewer process steps than prior art flat panel display manufacturing processes, thereby increasing yield and throughput rates. The present invention achieves the above accomplishments with a flat panel display and a method of forming a flat panel display which allows for forming a vacuum within the flat panel display prior to sealing the flat panel display at a low temperature. The present invention eliminates the need for an evacuation tube and eliminates fabrication steps required by prior art processes.

In one embodiment of the present invention a backplate is formed by forming a cathode on an active area surface of a glass plate. The faceplate is formed by depositing luminescent material within an active area surface formed on a glass plate. Walls are attached to the faceplate using supporting structures which mechanically hold each wall to the faceplate. A glass sealing material is placed within the border of the faceplate. The backplate is then placed over the faceplate such that the walls and the glass frit are disposed between the faceplate and the backplate. The assembly is then sealed by thermal processing and evacuation steps so as to form a complete flat panel display.

Since the supporting structure of the present invention keeps the walls in the correct location and orientation, the walls are maintained in the proper location and orientation, without the need to form and attach feet to each wall, from the time the supports are placed in the display until the seal process is finished, resulting in the permanent capture of the walls in the correct location and orientation. Thus, feet are not required in order to maintain walls in the correct orientation.

In one embodiment of the present invention, a black matrix structure is formed by depositing, masking, exposing and developing polyimide. Polyimide is used because it has the required structural integrity and because it is easy to deposit, mask and develop. In addition, polyimide has a low outgassing rate. In one embodiment, the black matrix structure consists of adjoining parallel raised surfaces which have opposing supporting surfaces or "grippers" that form a slot between the adjoining raised surfaces. The walls fit within the slots such that the side surfaces of the slot mechanically restrain each wall. In another embodiment, a slot is formed by the deposition, exposure and development of polyimide which so as to form supporting surfaces (grippers) which mechanically restrain each wall. Since feet are not required, the walls need not extend out of the active area surface of the display, further reducing or eliminating border width required for walls.

In yet another embodiment, multiple wall segments are used instead of individual walls which extend completely across the active area surface. The use of multiple wall segments allows for the same size of wall segment to be used irrespective of the size of the flat panel display. Thus, one set of fabrication equipment and one set of segment sizes may be used to make wall segments irrespective of the size of the active area surface of the display. This saves on capital equipment and eliminates the time required for retooling for making different sizes of displays. In addition, the wall segments need not extend out of the active area surface of the display, further reducing or eliminating border width required for walls.

Since walls are held in the proper position using structures formed on the faceplate and/or on the backplate, there is no need to manufacture and attach feet to each wall. Thus, the present invention results in reduced fabrication time and reduced cost of manufacture for wall fabrication. In addition, since the present invention does not require feet, as are required in prior art processes, the width of the border may be reduced.

In an alternate embodiment, a U. V. cured adhesive is used to maintain the walls in the proper location and orientation. In this embodiment, the UV curable adhesive is disposed outside of the active region of the display on one or both sides of each wall. Ultraviolet light is used to cure the adhesive. The use of ultraviolet light to cure the adhesive results in quick efficient bonding and eliminates the high temperature processing steps of prior art processes that use glass frit. In addition, the use of UV curable adhesive allows for the cure of the adhesive using the wall placement equipment such that a separate fixture for holding the walls in place is not required as is required in prior art processes that use glass frit to bond walls in place. Since the UV curable adhesive is electrically non conductive, there is no problem of arcing as in prior art displays, allowing for reduced border width. Since the prior art step of heating the glass frit so as to bond the walls to the faceplate is eliminated, outgassing is reduced, manufacturing expense is reduced and throughput and yield are increased.

In yet another embodiment of the present invention, heat cured polymer is used to bond walls to the faceplate. Alternatively, conductive material may be used to bond walls to the faceplate. The use of conductive material allows for the electrical connection of electrical traces on the faceplate to electrical traces on each wall.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

In one embodiment of the present invention, faceplate 101 is a glass plate onto which successive layers of material have been deposited so as to form black matrix structure 102. An active area surface formed within black matrix structure 102 includes one or more layers of phosphor. These phosphor layers emit light when activated by high energy electrons so as to form a visible display. Walls 103–120 are attached to faceplate 101 such that they extend vertically along a plane perpendicular to top surface 130 of faceplate 101.

Figure 1:
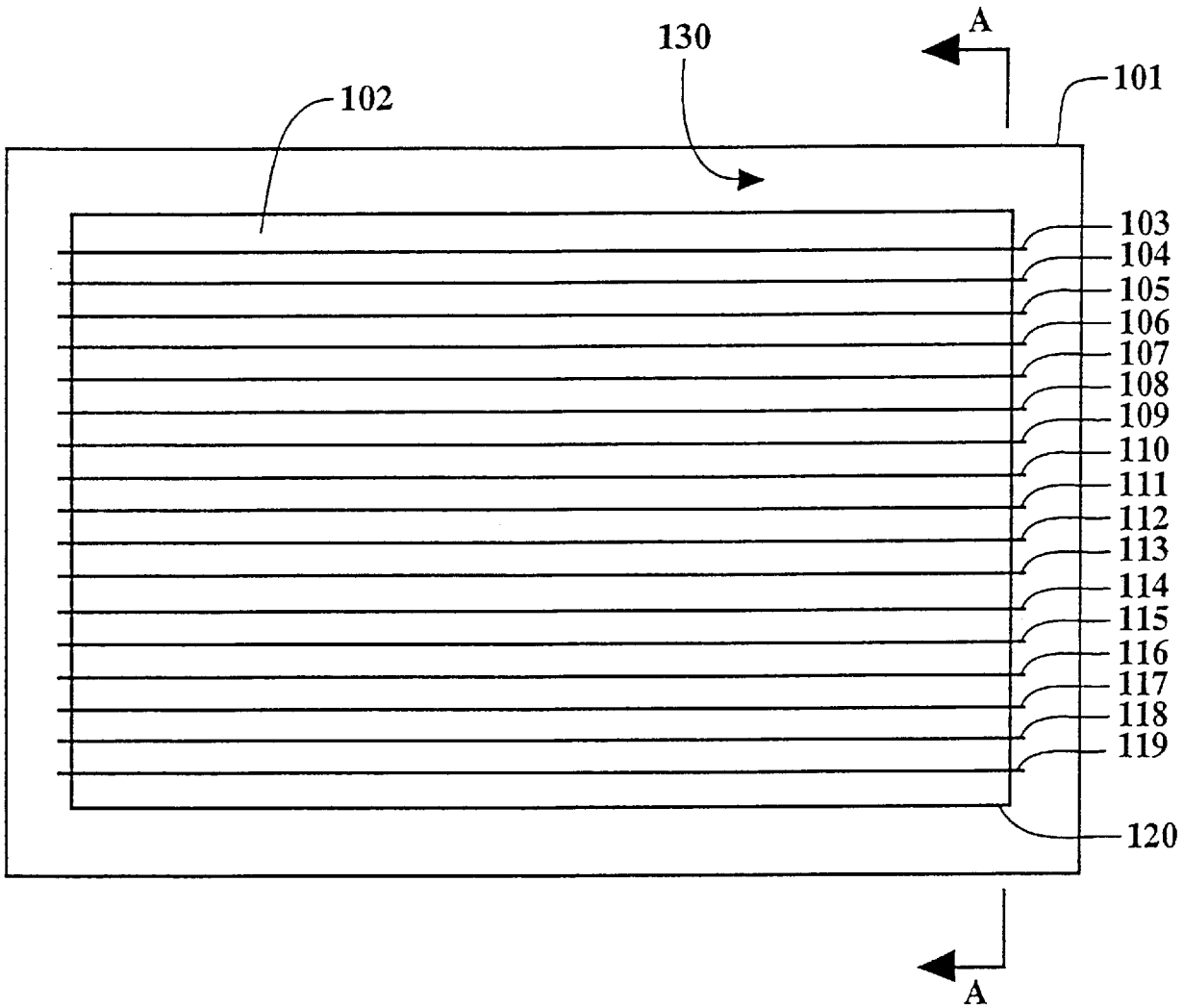
FIG. 1 is a top view illustrating a faceplate over which walls are located in accordance with the present claimed invention.
Figure 2:
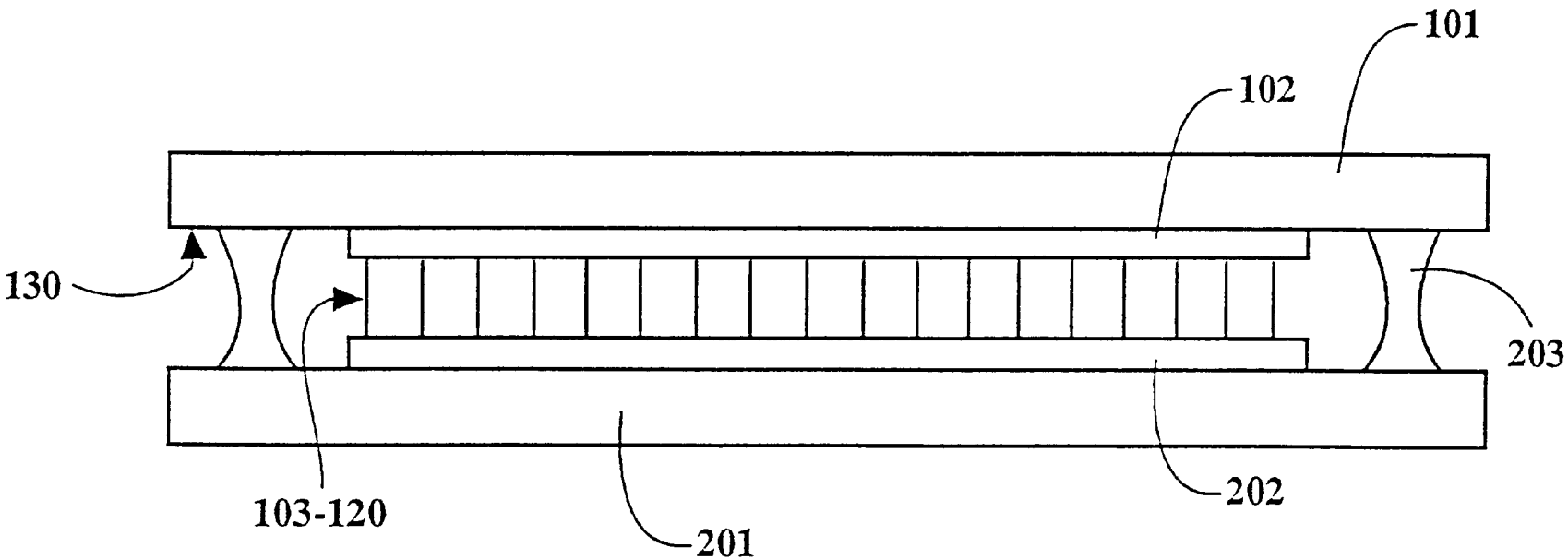
FIG. 2 is a side cross sectional view along axis A—A of FIG. 1 illustrating a flat panel display in accordance with the present claimed invention.

With reference to FIG. 2, walls 103–120 extend vertically between backplate 201 and faceplate 101 so as to give uniform spacing between faceplate 101 and backplate 201. In one embodiment of the present invention, backplate 201 of FIG. 2 is formed with an active area surface which includes a cathodic structure 202 having emitters which emit electrons. Cathodic structure 202 does not cover the entire surface area of backplate 201 so as to allow enough space around the periphery of backplate 201 for sealing backplate 201. Glass seal 203 extends around the periphery of backplate 201 and faceplate 101 within the border region so as to form an enclosure that contains cathodic structure 202, black matrix structure 102, and walls 103–120. In one embodiment of the present invention, seal 203 is formed by melting glass frit. The active area surface formed on faceplate 101 is disposed across from the active area surface of backplate 201 so as to form an active area therebetween.

Figure 3:
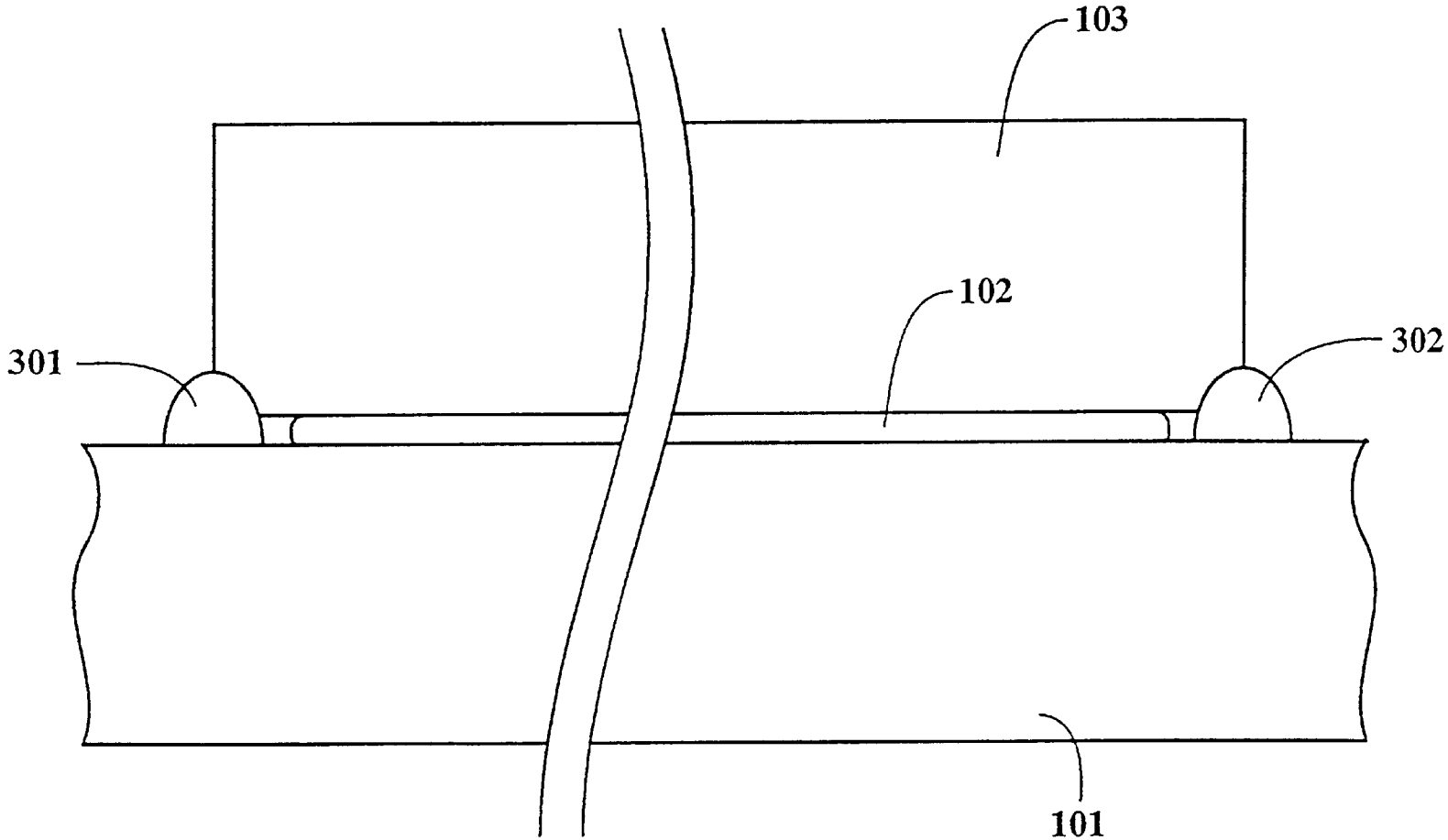
FIG. 3 is a side view illustrating a wall which is attached to a faceplate in accordance with the present claimed invention.

FIG. 3 shows an embodiment in which wall 103 is held in place by adhesive drop 301 located on one end of wall 103 and adhesive drop 302 located on the opposite end of wall 103. In one embodiment of the present invention, a UV curable polyimide adhesive such as Probimide 7020 manufactured by Olin Corporation is used to form adhesive drops 301–302. Alternatively, a thermally cured adhesive such as Epo-Tek P1011 or an inorganic adhesive may be used. Adhesive deposits 301–302 are placed outside of structure 102 such that they do not interfere with the operation of the flat panel display. In one embodiment, a fraction of a cubic centimeter of Probimide is deposited using an automated dispenser. Wall 103 is inserted such that it cuts the Probimide so as to form an equal Probimide meniscus on each side of wall 103. The resulting Probimide deposits are then cured by applying UV light for 60 to 90 seconds. In one embodiment, UV light having a wavelength of 365 nanometers is applied using fiber optic delivery to cure adhesive deposits 301–302. Alternatively, a stream of air heated to approximately 150 degrees centigrade is applied to adhesive deposits 301–302 for three minutes. It is important to form an equal adhesive meniscus on each side of wall 103 so that, when the adhesive cures, there is no movement and no resulting misalignment of wall 103.

Alternatively, a single adhesive drop could be used, placing the drop on one end or the other of each wall instead of on both ends. This would prevent any distortion and bending of the wall due to mismatch between the coefficient of thermal expansion of the materials of the glass substrate and the walls in a high temperature environment. However, the adhesive tends to shrink after curing and acts as a spring, pulling the wall so as to make the wall tilt along the longitudinal axis of the wall. Therefore it is important to make sure the wall is securely held in place, such as by a mechanical fixture, until the adhesive cures.

The chemical properties of the UV curable polymer adhesive allow for room temperature UV curing and the imidization that occurs during subsequent thermal process steps provides structural integrity. The UV curable polymer has low outgassing rate (less than $10^{-11}$ liter torr/sec).

Figure 4:
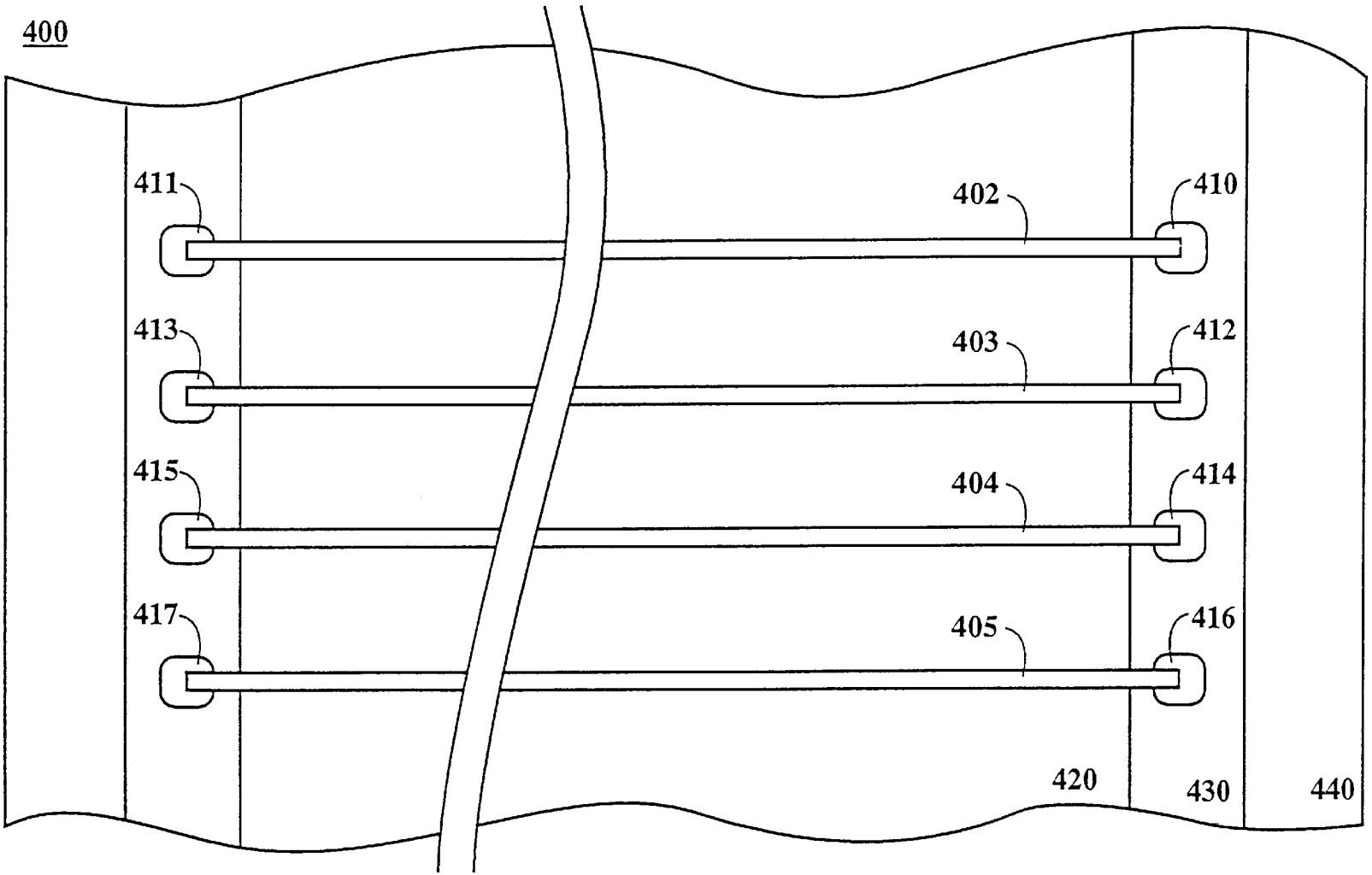
FIG. 4 is a top view illustrating walls attached to a faceplate in accordance with the present claimed invention.

In an alternate embodiment of the present invention shown in FIG. 4, preformed adhesive blocks 410–417 are used to attach walls 402–405 to faceplate 400. Faceplate 400 includes glass plate 440 over which black matrix structure 430 is formed. In one embodiment black matrix structure 430 is formed by depositing polyimide over glass plate 440 and forming active area surface 420 therewithin by depositing phosphors within openings in black matrix structure 430 such that phosphors overlie glass plate 440. Wall 402 is supported on one end by adhesive block 410 and on the other end by adhesive block 411. Similarly, wall 403 is supported on one end by adhesive block 412 and on the other end by adhesive block 413. Adhesive blocks 410–417 are u-shaped such that walls 402–405 nest within the center of adhesive blocks 410–417. In one embodiment, preformed adhesive blocks 410–417 are u-shaped and they are formed of bismaleimide. The bismaleimide adhesive blocks are cured by applying heat. Since bismaleimide does not cause arcing when placed near an active area surface, the length of walls 402–405 needs only be long enough to extend through active area surface 420. Blocks 410–417 are placed within the border area so that the adhesive does not interfere with the operation of the active area surface 420 of the display. Thus, though a border area is required for the attachment of blocks 410–417, the width of the border region surrounding active area surface 420 is smaller than that of prior art displays.

Figure 5A:
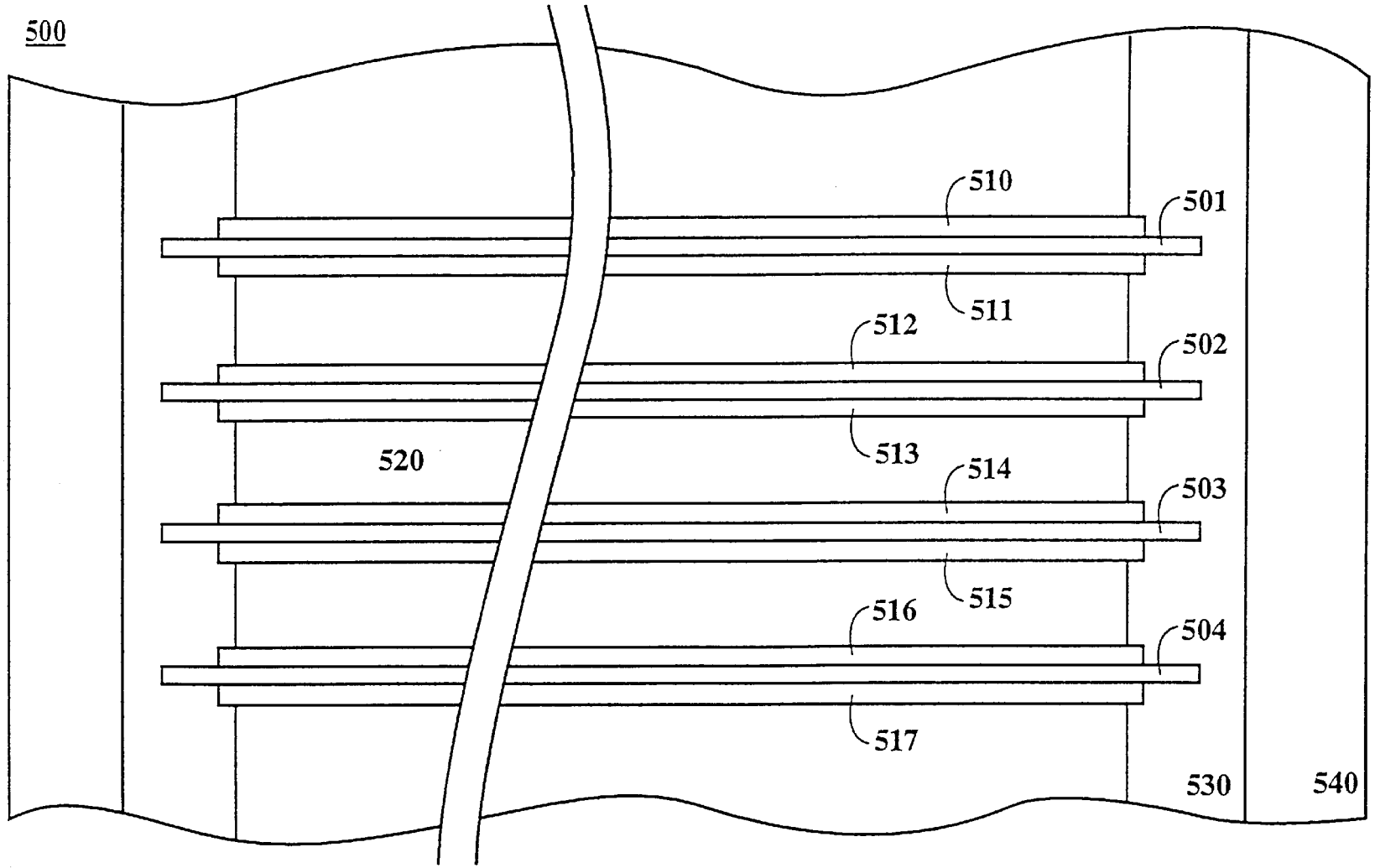
FIG. 5A is a top view illustrating walls attached to a faceplate in accordance with the present claimed invention.

In another embodiment of the present invention, faceplate 500 includes supporting structures which includes grippers 510–517 which support walls 501–504 of FIG. 5A. In this embodiment black matrix structure 530 is deposited over glass plate 540 and grippers 510–517 are formed over black matrix structure 530 such that they extend across active area surface 520. The sides of grippers 510–517 are spaced such that the distance between each opposing gripper allows for the insertion of one of walls 501–504 therebetween. Grippers 510–511 form a supporting structure which extends parallel to the longitudinal axis of wall 501 and are disposed on each side of wall 501 such that grippers 510–511 mechanically hold wall 501 perpendicular to the top surface of faceplate 500. Similarly, grippers 512–513 mechanically restrain wall 502, grippers 514–515 mechanically restrain wall 503, and grippers 516–517 mechanically restrain wall 504. Hence, the present invention does not require feet as are required in prior art flat panel displays, thereby reducing or eliminating the required border area. This reduces manufacturing costs, gives greater throughput, better yield, and a larger active area for a given size of glass plate.

Figure 5B:
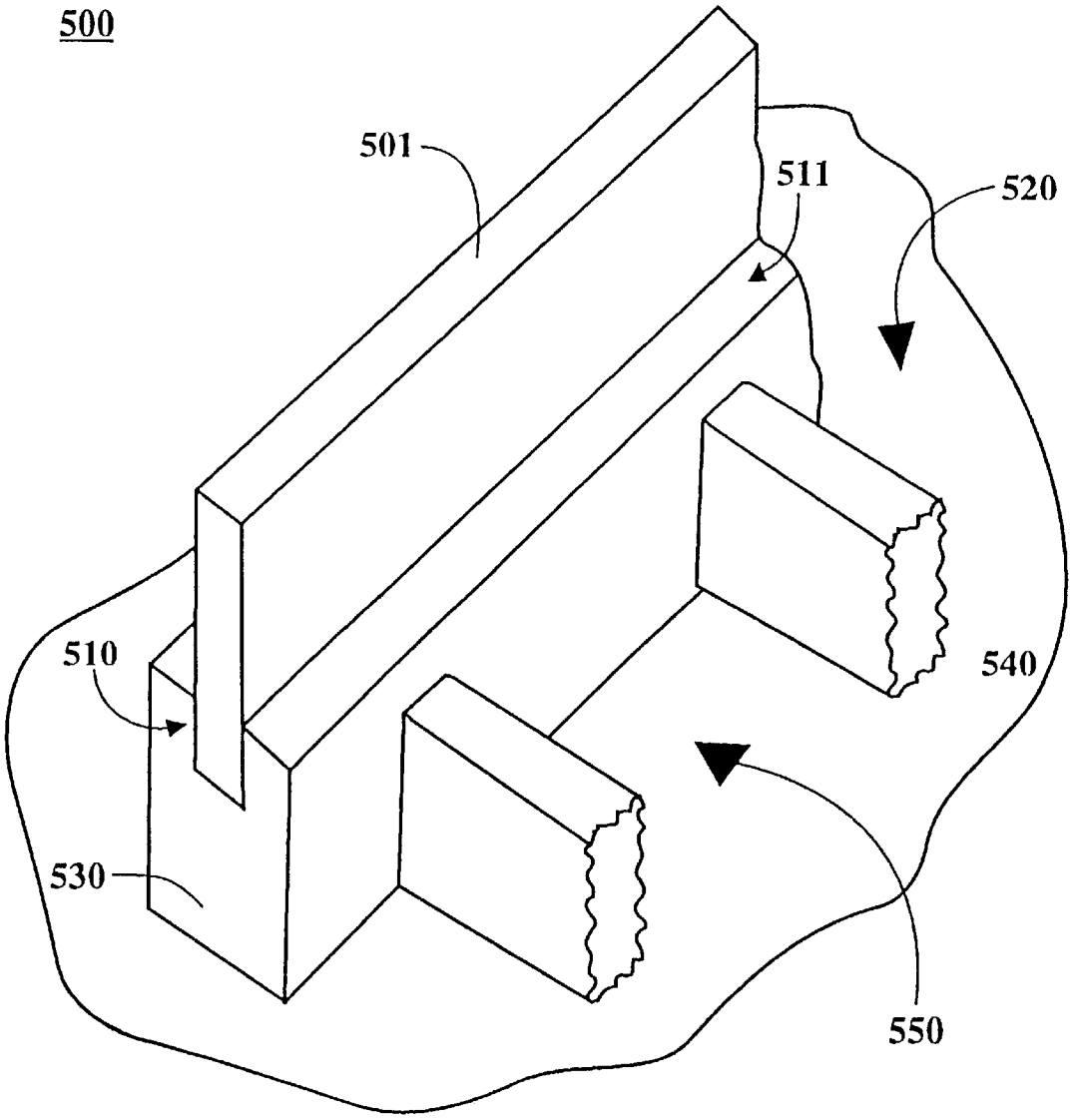
FIG. 5B is a perspective view illustrating a wall attached to a faceplate in accordance with the present claimed invention.

In one embodiment, grippers 510–517 of FIG. 5A are integrally formed within black matrix structure 530 by the deposition, mask, and etch or development of multiple layers of conductive and dielectric materials. In this embodiment, grippers such as grippers 510–511 of FIG. 5B extend from black matrix structure 530. Grippers 510–511 are located such that wall 501 fits therebetween, thereby supporting wall 501 in a vertical position. Phosphor well 550 is shown to be formed over glass plate 540 within active area surface 520 of faceplate 500.

Figure 5C:
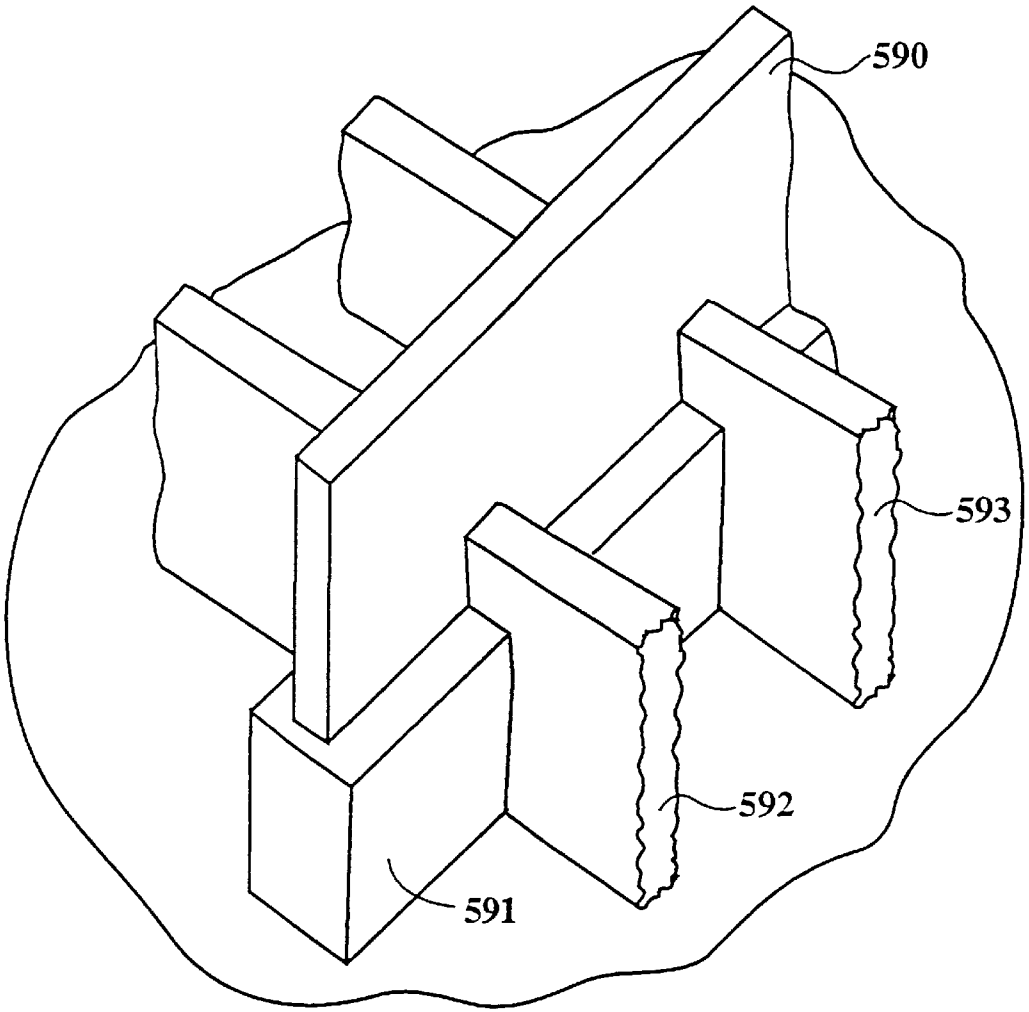
FIG. 5C is a perspective view illustrating a wall attached to a faceplate in accordance with the present claimed invention.

In another embodiment, the structure shown in FIG. 5C is used to support wall 590 in a vertical position. In this embodiment, wall 590 lies above black matrix structure 591 and grippers 592 and 593 include corresponding slots which receive wall 590, thereby supporting wall 590 in a vertical position.

Figure 6A:
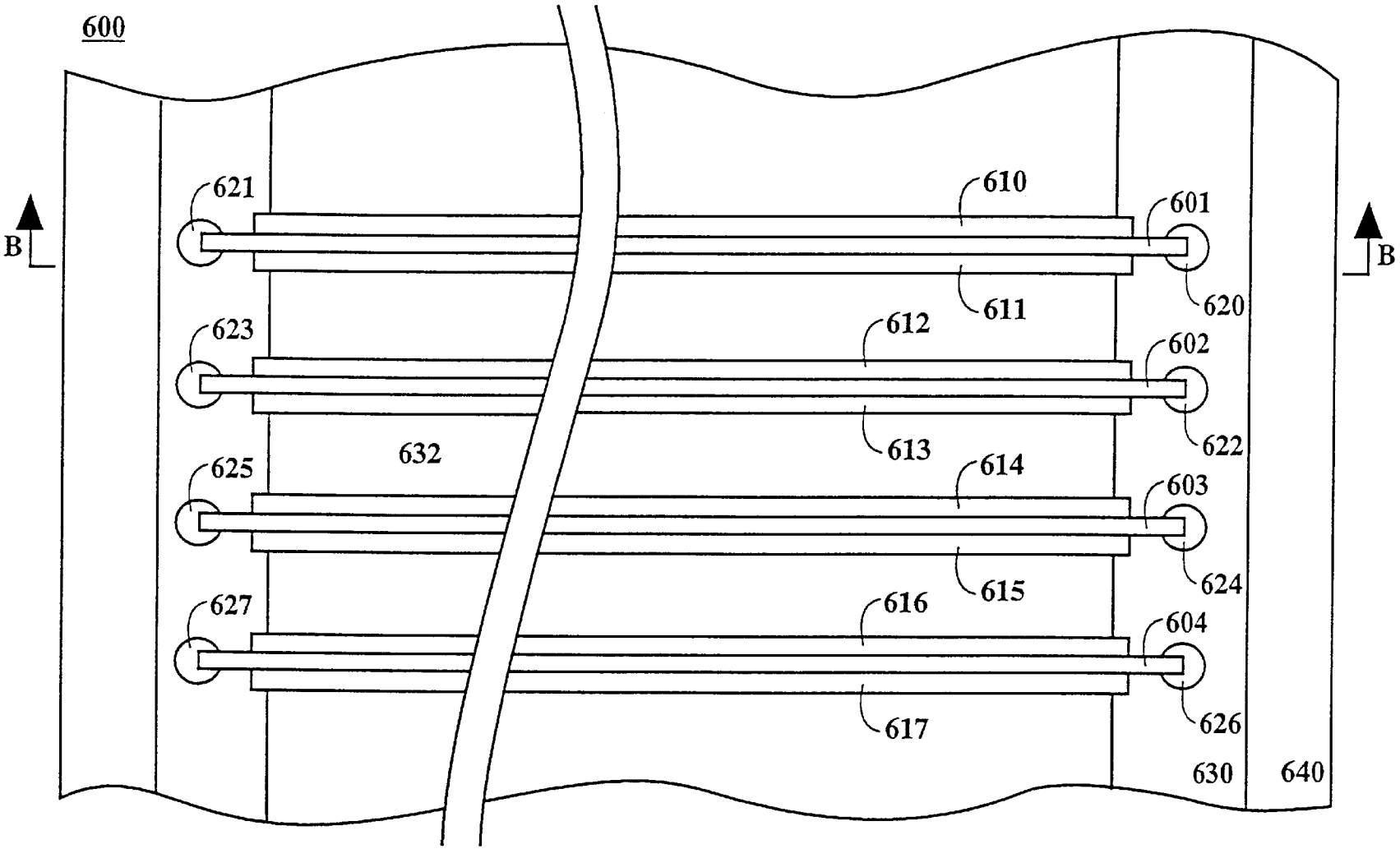
FIG. 6A is a top view illustrating walls attached to a faceplate in accordance with the present claimed invention.
Figure 6B:
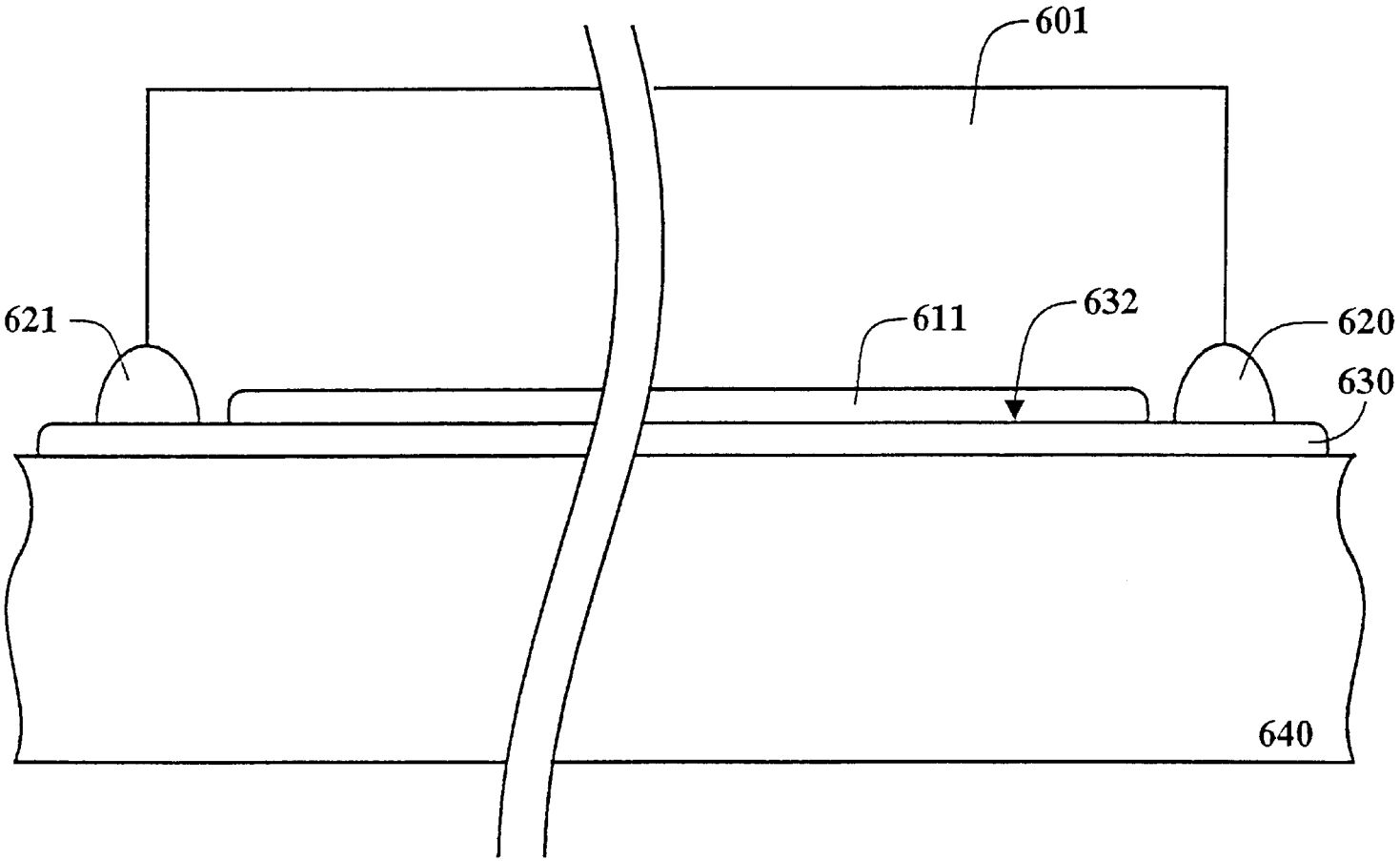
FIG. 6B is a cross sectional view along axis B—B of FIG. 6A illustrating a wall which is attached to a faceplate in accordance with the present claimed invention.

In an alternate embodiment of the present invention, walls 601–604 are attached to faceplate 600 of FIGS. 6A–6B using both grippers 610–617 and adhesive. In one embodiment, an adhesive which is UV curable is deposited on both ends of each of walls 601–604 so as to form adhesive drops 620–627. Wall 601 is supported by both grippers 610–611 and drops 620–621. Similarly, wall 602 is supported by both grippers 612–613 and drops 622–623. In the same manner, walls 603 and 604 are supported by grippers 614–617 and are secured by drops 624–627. Grippers 610–617 are formed over structure 630 which is formed over glass plate 640. Structure 630 includes active area surface 632 within which phosphor is deposited. Since the present invention does not require feet as are required in prior art flat panel displays, the border area requirement for walls is reduced or eliminated. This reduces manufacturing costs, gives greater throughput, better yield, and a larger active area surface for a given size of glass plate.

FIG. 6B shows a cross sectional view of the structure shown in 6A along axis B—B. In one embodiment, layer 630 is formed of polyimide and has a height of 10 to 25 microns. Gripper 611 is also formed of polyimide and has a height of approximately 38 to 60 microns. Alternatively, preformed adhesive blocks such as preformed adhesive blocks 410–417 of FIG. 4 could be used in place of drops 620–627. By using preformed adhesive blocks, the present invention does not require feet as are required in prior art flat panel displays, reducing or eliminating the required border area. In addition, since preformed adhesive blocks are easy and inexpensive to fabricate, manufacturing costs are reduced. Moreover since there is no need to manufacture feet, the present invention gives greater throughput, better yield, and a larger active area surface for a given size of glass plate.

Figure 7:
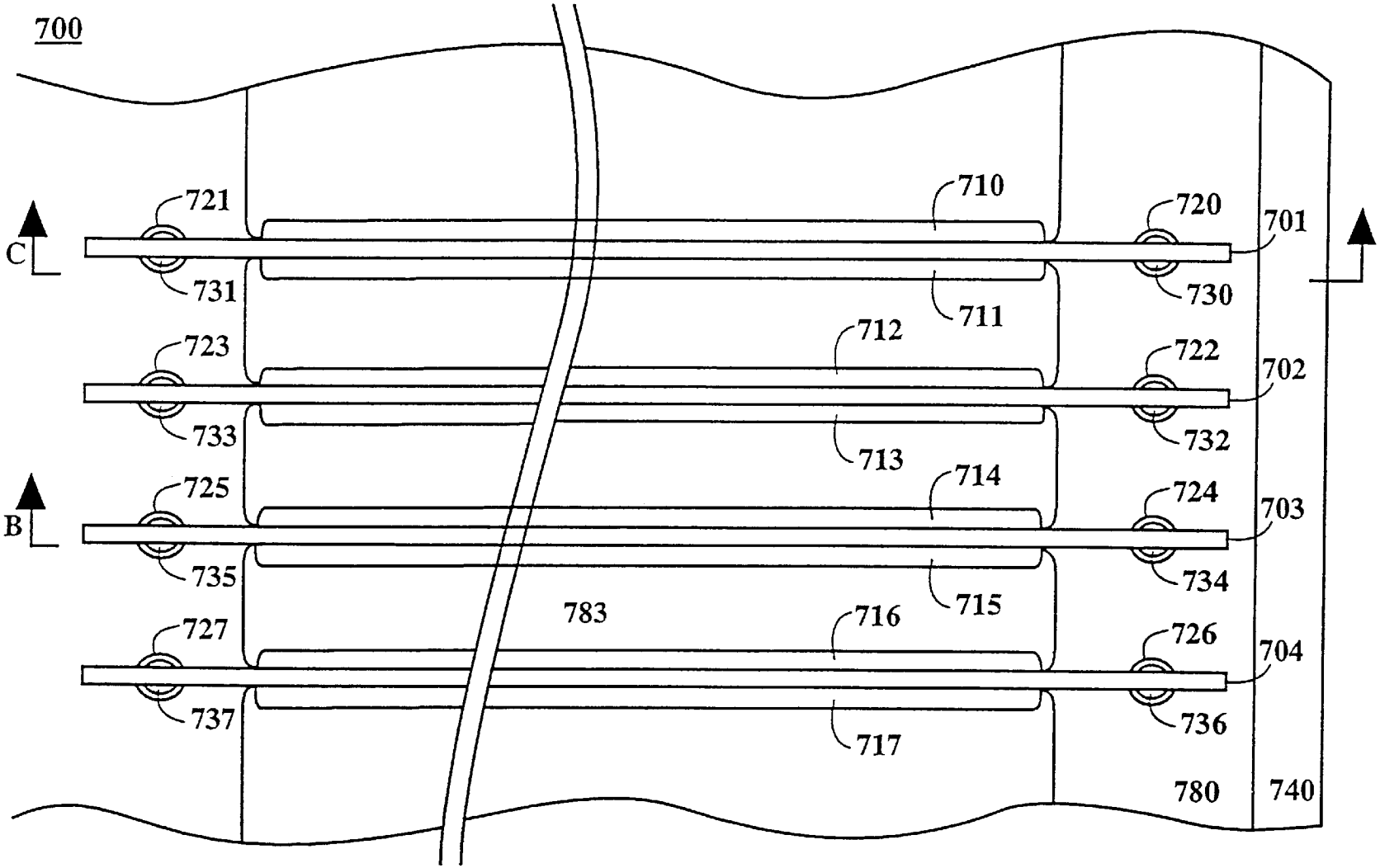
FIG. 7 is a top view of a flat panel display in accordance with the present claimed invention.
Figure 8:
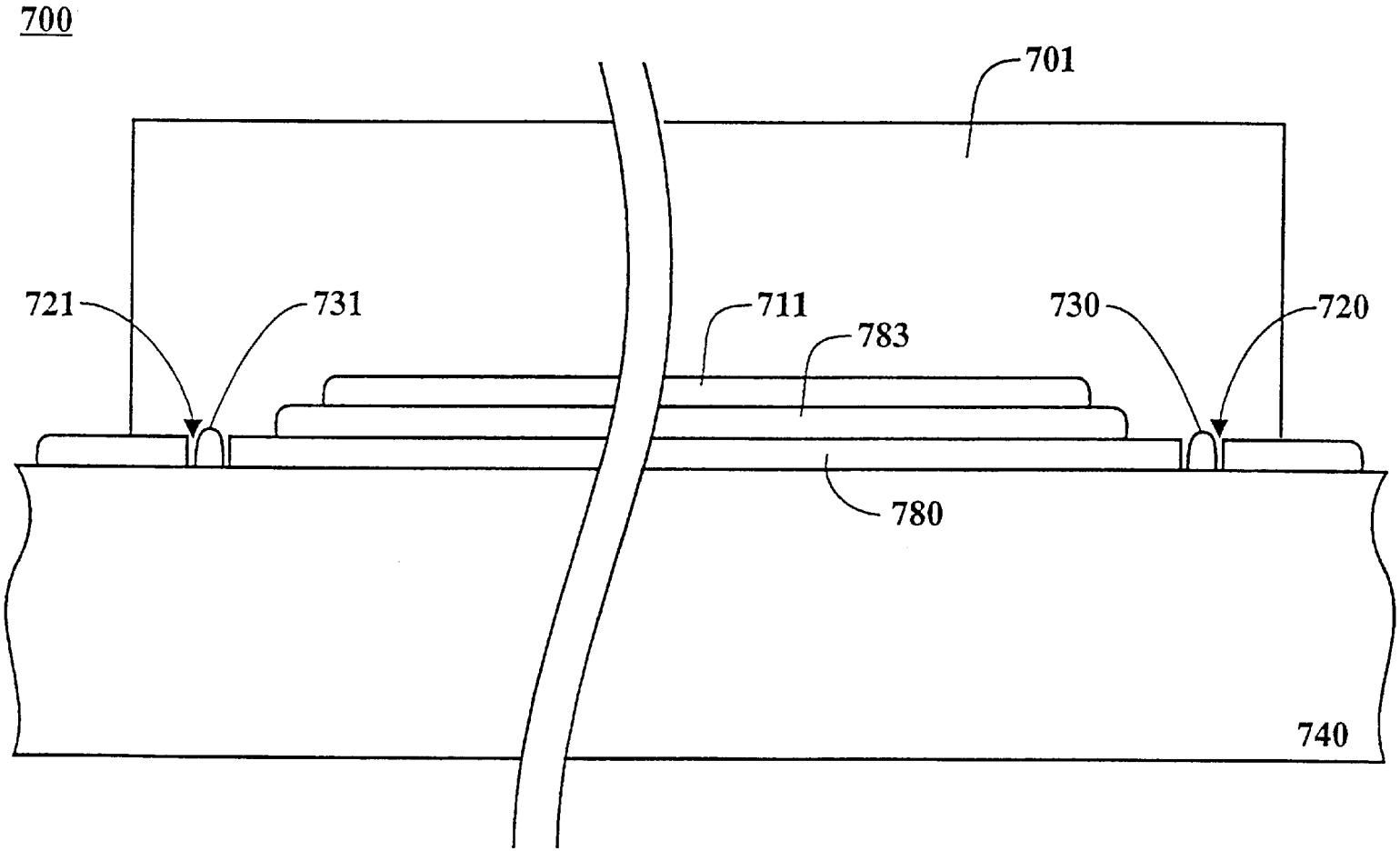
FIG. 8 is a cross sectional view along axis C—C of FIG. 7 illustrating a wall which is attached to a faceplate in accordance with the present claimed invention.

FIGS. 7–8 show another embodiment which secures walls onto faceplate 700 using both grippers and adhesive. In the embodiment shown in FIGS. 7–8, reservoirs 720–727 are formed within structure 780. In one embodiment structure 780 is formed of polyimide. Walls 701–704 are securely held in place by grippers 710–717 and adhesive drops 730–737. That is, wall 701 is secured by grippers 710–711 and adhesive drops 730–731. Similarly, walls 702–704 are secured by grippers 712–717 and adhesive drops 732–737. Structure 780 includes layer 783 which has an active area surface formed therewithin. Reservoirs 720–727 are formed outside of layer 783 such that adhesive drops 730–731 do not contact the active area surface.

With reference to FIG. 8, wall 701 overlies layer 780 and is attached thereto by adhesive drops 730–731. Reservoir 720 contains adhesive drop 730 and reservoir 721 contains adhesive drop 731. Layer 783 overlies structure 780 and has a channel formed therein for receiving wall 701 such that wall 701 is supported by gripper 711 and layer 783. This structure may be obtained by depositing layer 783 and then depositing a layer thereover and masking and developing so as to form the structure of gripper 711 and to form a trench which extends through gripper 711 and through layer 783. By using reservoirs, the problems associated with the adhesive wicking under the walls is eliminated. Alternatively, structure 780 and layer 783 may be combined into one layer.

In an embodiment that uses glass frit to bond walls, a laser may be used to melt the glass frit so as to bond the walls. In such an embodiment, a low temperature glass frit is used. In this embodiment, a relatively low substrate heating (e.g. 200 degrees centigrade) is required, compared to conventional oven heating of glass frit at 450 degrees centigrade. The heating of sintered glass frit by laser will have sufficient integrity to sustain later high temperature process steps. In one embodiment, an infrared diode laser or a Nd:YAG (1.06 micrometer) laser is used to bond walls using glass frit.

In one embodiment of the present invention, the low temperature glass frit is formed by mixing approximately 2 percent to 4 percent by weight Q-pac organic compound with NEG low temperature glass. Q-pac organic compound may be purchased from Pac Polymer of Delaware and NEG low temperature glass may be purchased from Nippon Electrical Glass of Ostu, Japan. The resulting low temperature glass frit has a bias temperature of 200 degrees centigrade.

Figure 9:
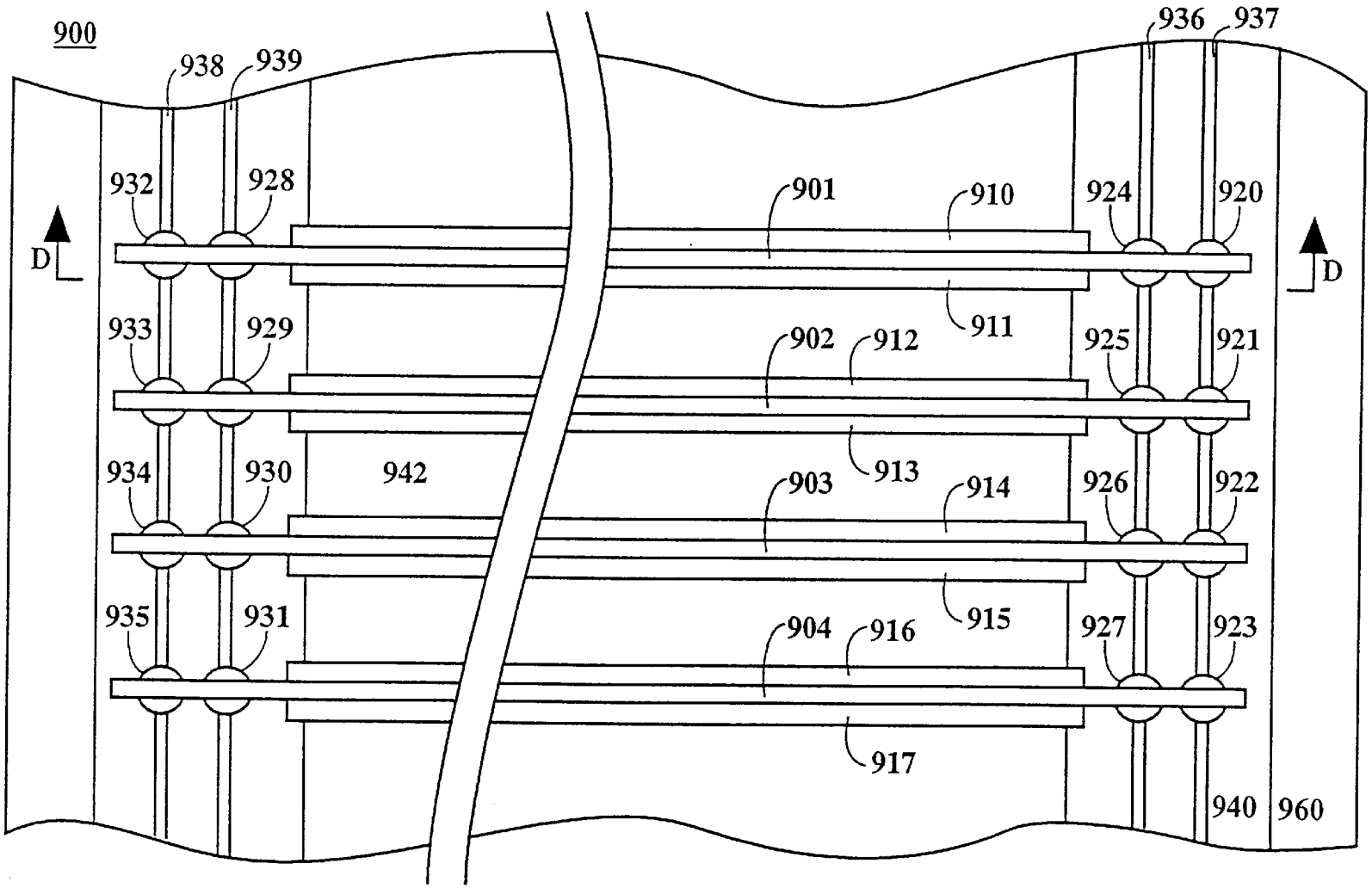
FIG. 9 is a top view illustrating walls attached to a faceplate in accordance with the present claimed invention.
Figure 10A:
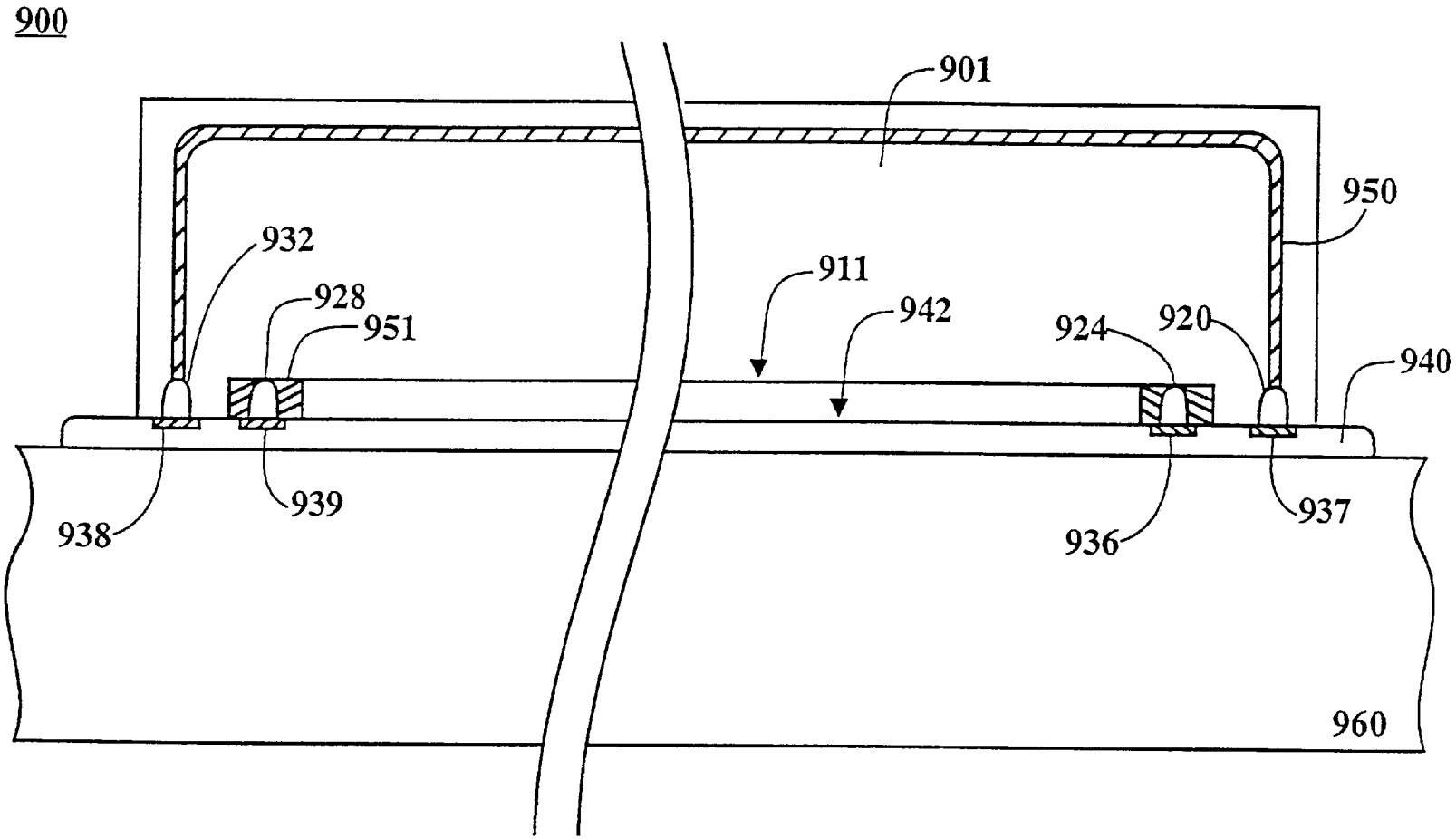
FIG. 10A is a side cross sectional view along axis D—D of FIG. 9 illustrating a wall which is attached to a faceplate in accordance with the present claimed invention.

FIGS. 9–10A illustrate an embodiment in which grippers 910–917 and conductive bonds 920–935 are used to secure walls 901–904 to faceplate 900. In this embodiment conductive material is used to form conductive bonds 920–935 of FIG. 9. In one embodiment, an eutectic solder using gold and indium compound is used to form bonds 920–935 ( In an eutectic solder, two metals which each have a low melting temperature but which have a high melting temperature once the two materials are mixed are used). A low temperature heating process is then used to melt the conductive material so as to weld walls 901–904 to conductive lines 936–939. Conductive bonds 920–935 secure walls 901–904 and make electrical contact between conductive lines formed within each wall and conductive lines 936–939. Alternative heating processes include using a focused laser, using an infrared lamp, using hot air, using ultrasonic bonding methods, or applying heat by heating the device which places the walls into their proper position (the end effector).

In one embodiment, conductive lines 936–939 of FIG. 9 are formed of gold and the edges of walls 901–904 are coated with indium where they contact conductive lines 936–939 such that bonds 920–935 are formed by low temperature transient liquid phase bonding. Alternatively, low temperature transient liquid phase bonding using indium and silver or indium, lead, silver and gold, or indium, tin, and gold could be used. In the low temperature transient liquid phase bonding process, a heating step is carried out at between 60 degrees and 160 degrees centigrade so as to melt the indium and the gold. The metals used in low temperature transient liquid phase bonding combine so as to form an alloy which has a substantially higher re-melting temperature. Thus, bonds 920–935 are formed such that they do not melt during high temperature processes steps. In one embodiment, a low temperature transient liquid phase bonding is performed using 52 percent indium and 48 percent gold which is melted at approximately 118 degrees centigrade so as to form bonds that have a re-melting temperature of over 400 degrees centigrade.

In another embodiment conductive lines 936–939 of FIG. 9 are covered with a brazing paste which is heated to form bonds 920–935. In one embodiment, an eutectic gold and copper alloy is used to form the brazing paste. In this embodiment, the brazing paste is heated to a temperature of 140–240 degrees centigrade.

FIG. 10A shows wall 901 to include conductive lines 950–951 which extend across the top and the bottom, respectively, of wall 901. Conductive lines 936–939 are formed within structure 940. Structure 940 also includes active area surface 942. Gripper 911 extends from the top surface of structure 940 so as to support wall 901.

Figure 10B:
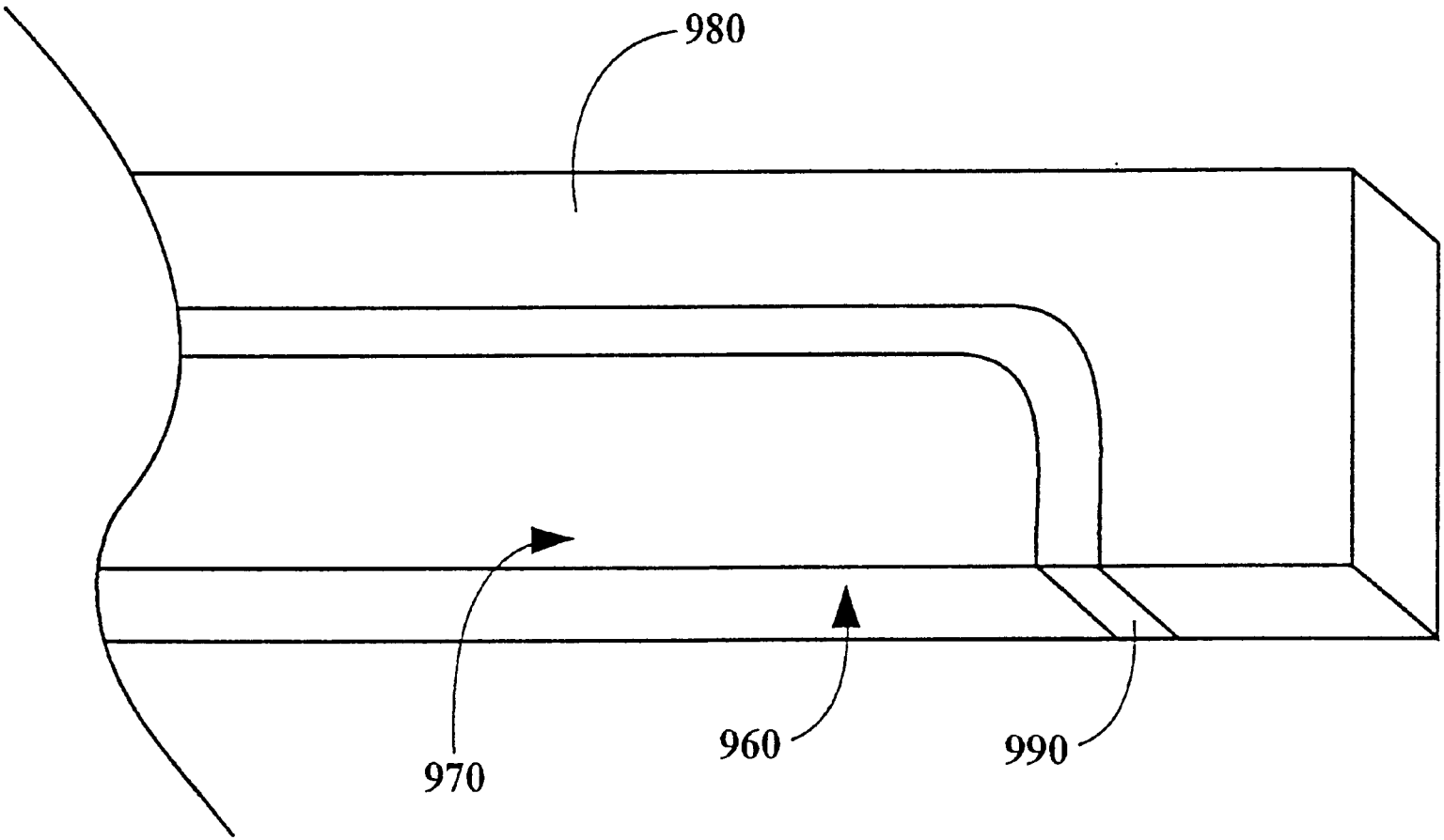
FIG. 10B is a perspective view of a wall in accordance with the present invention.

Alternatively, only one conductive strip could be formed on a particular wall. FIG. 10B shows an embodiment in which wall 980 includes conductive strip 990 which extends across side surface 970 and across bottom surface 960.

Figure 11:
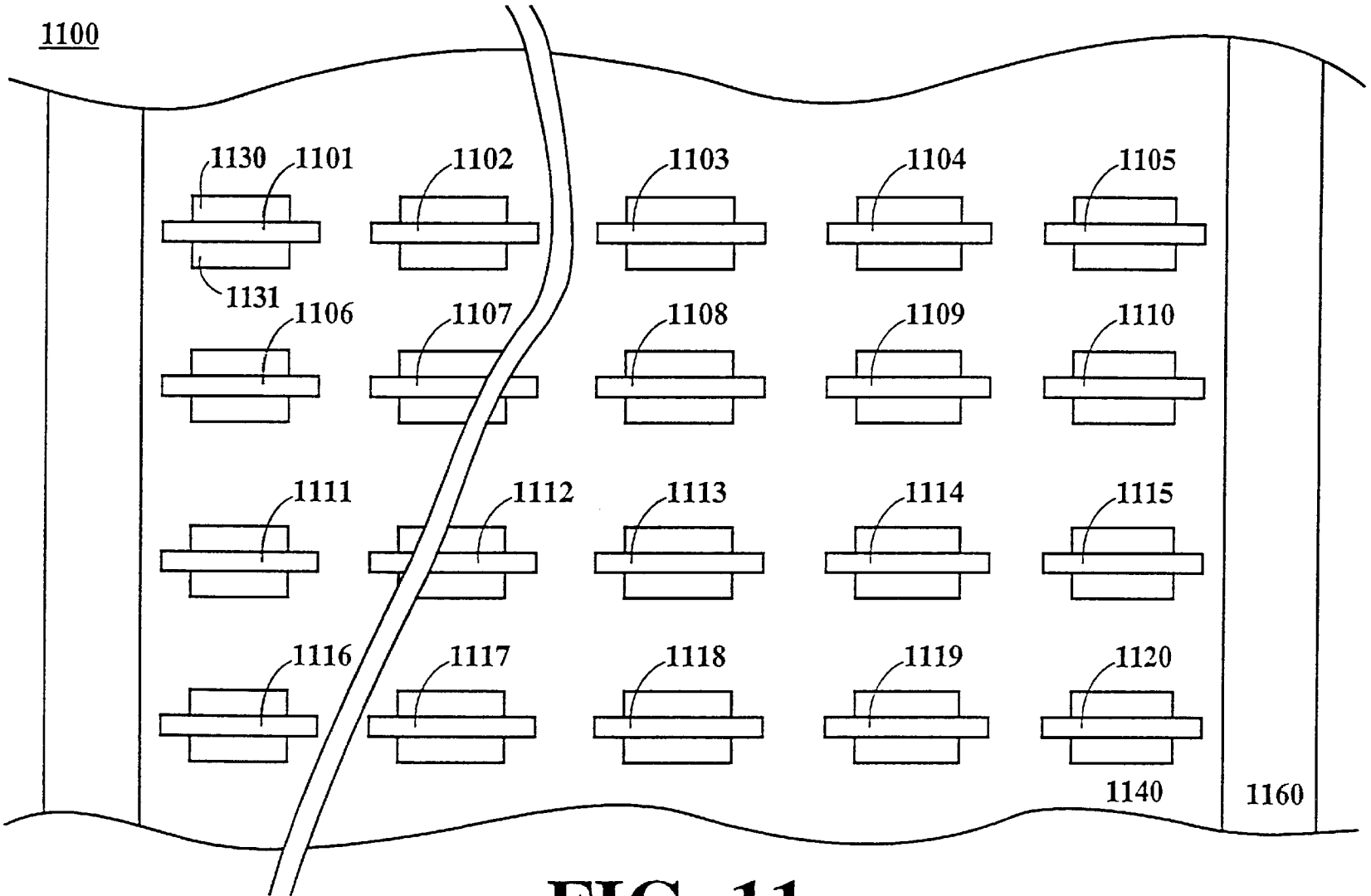
FIG. 11 is a top view illustrating wall segments attached to a faceplate in accordance with the present claimed invention.

FIG. 11 illustrates an alternate embodiment which includes wall segments 1101–1120 which are disposed within the active area surface 1140 of faceplate 1100. Wall segments 1101–1120 do not extend completely across active area surface 1140 as do walls shown in FIGS. 1–10. Instead, wall segments 1101–1120 are shorter such that multiple wall segments may be disposed across active area surface 1140 lengthwise. Gripper segments such as, for example, gripper segments 1130–1131 support wall segments 1101–1120. Faceplate 1100 includes active area surface 1140 formed over glass plate 1160. By using wall segments 1101–1120, the border region defined by the space between active area surface 1140 and the edges of glass plate 1160 may be reduced. This allows for a wider display area (active area) for each size of faceplate since there is no need to allow space for extending and attaching walls.

Alternatively, wall segments may be attached using conductive material so as to make electrical contact between wall segments and conductive lines located on the faceplate. In one embodiment, wall segments are resistive so as to allow electrons striking the wall segment to "bleed off" by traveling along the conductive lines located on the faceplate to the power supply. In one embodiment, walls are made from resistive material. Alternatively, walls may be formed using a material which is an insulator which is coated with a resistive coating.

In another embodiment, a conductive strip is formed on each wall segment which is connected to the electrical circuits of the faceplate by conductive bonds. In the embodiment shown in FIG. 12A, conductive. strip 1202 is formed on wall segment 1201 such that it partially extends across the bottom of side surface 1204 and the bottom surface 1206 of wall segment 1201. Wall segment 1201 is made of a resistive material such that electrons striking the wall segment "bleed off" by traveling through conductive strip 1202 which is electrically connected to the power supply.

Figure 12A:
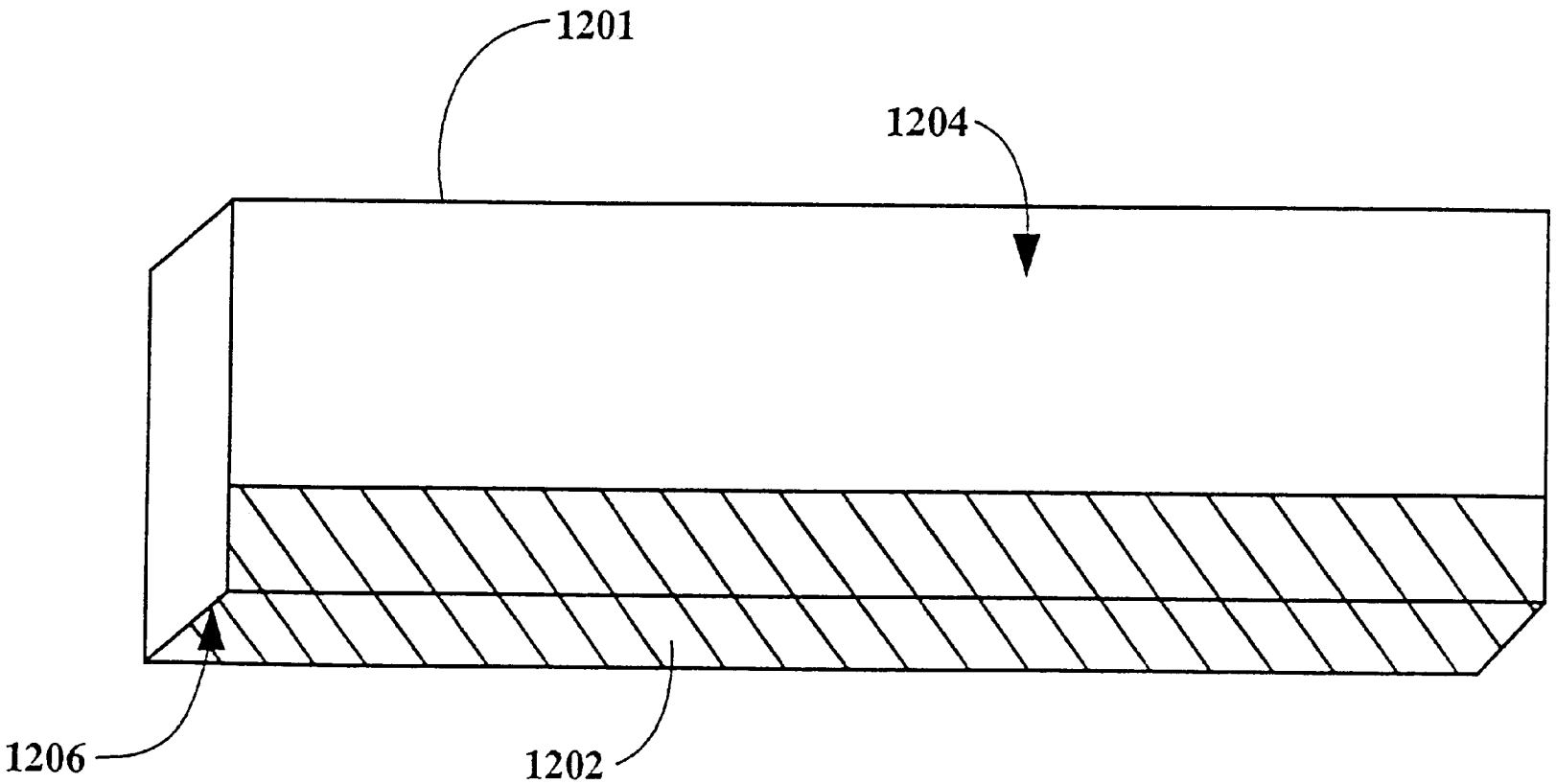
FIG. 12A is a perspective view of a wall segment in accordance with the present claimed invention.
Figure 12B:
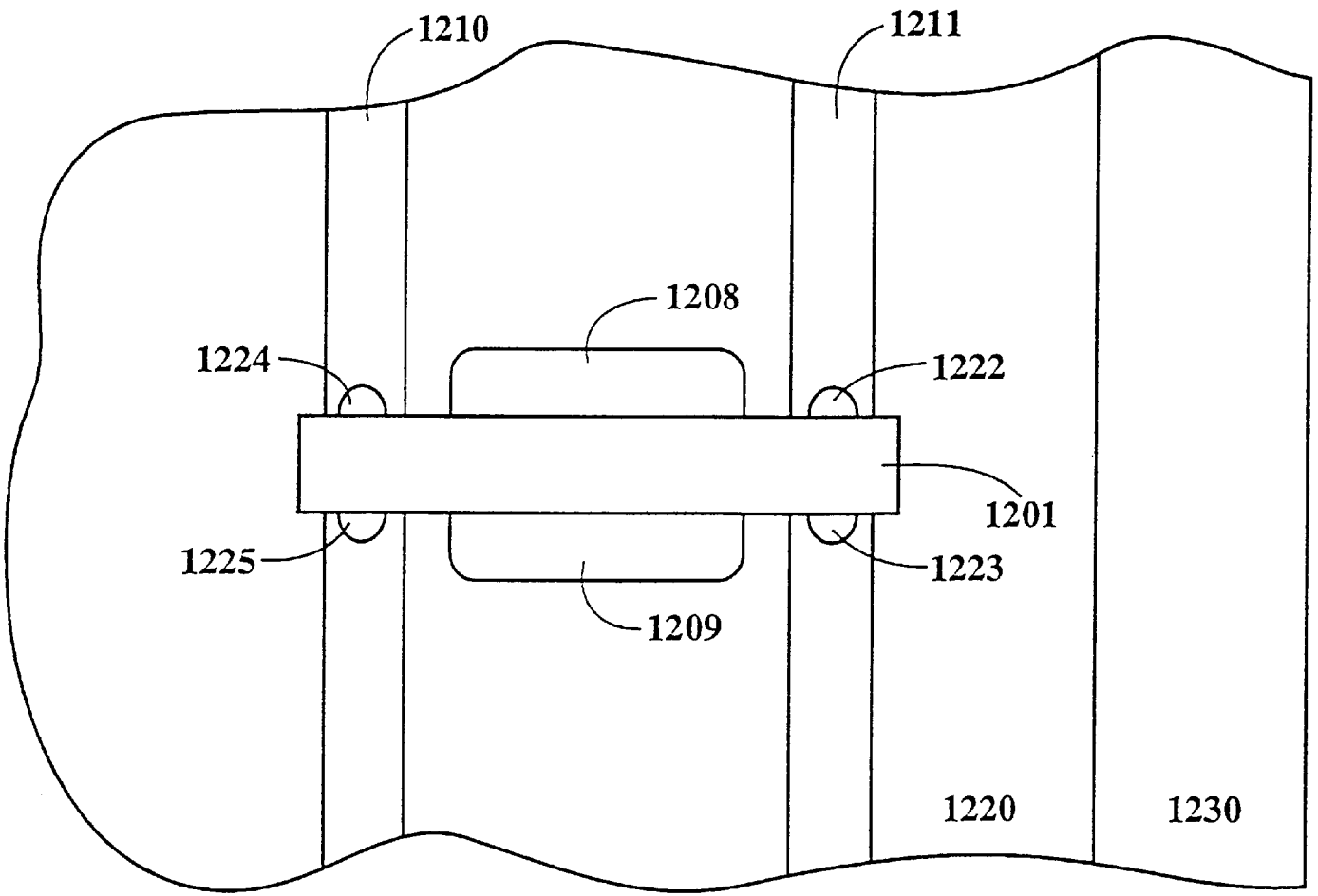
FIG. 12B is an expanded top view illustrating a wall segment attached to a faceplate in accordance with the present claimed invention.

With reference to FIG. 12B, wall segment 1201 is supported by gripper segments 1208–1209 and is attached to electrically conductive lines 1210–1211 by conductive bonds 1222–1225. Conductive lines 1210–1211 are formed within active region 1220 of faceplate 1230. In one embodiment conductive lines 1210–1211 are formed during the process of forming gripper segments 1208–1209 by exposing an underlying conductive layer so as to form conductive lines 1210–1211. In one embodiment, the conductive material used to form conductive bonds 1222–1225 consists of eutectic mixture of two or more materials that have a low melting point and which have a high melting point once they are mixed together with the contact pad material as they are melted. In one embodiment conductive bonds are formed by an eutectic solder. Alternatively, conductive bonds are formed using an eutectic brazing process. In an alternate embodiment, conductive glass frit or conductive UV curable adhesive could be used to form conductive bonds 1222–1225.

Though wall segment 1201 of FIGS. 12A–12B is shown to be bonded with reference to four bonds, alternatively, any number of bonds could be used and connection could be to any of a number of strips. With reference to contact with a conductive region, any of a number of bonds could be made to the conductive region. For example, wall segment 1201 could be connected using a single bond to a single conductive strip (not shown). In addition, though wall segment 1201 is shown to be supported by both grippers and conductive bonds, alternatively, wall segment 1201 could be supported entirely by conductive bonds such as conductive bonds 1222–1225.

Figure 13:
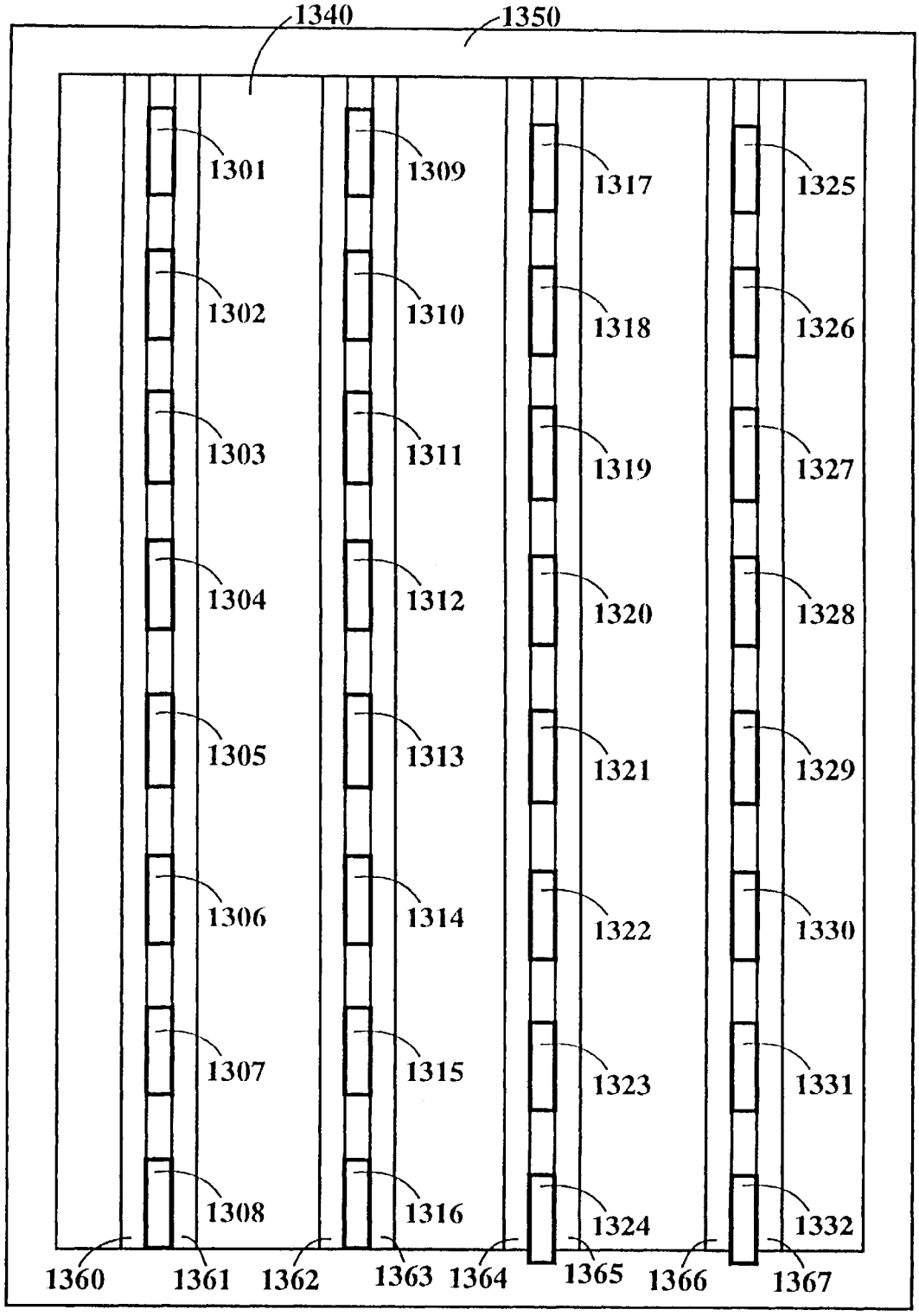
FIG. 13 is a top view illustrating wall segments attach to a faceplate in accordance with the present invention.

FIG. 13 shows an embodiment in which wall segments 1301–1332 are used in combination with grippers 1360–1367 that extend across active area 13 of faceplate 1360. Grippers 1360–1367 and wall segments 1301–1332 are shown as running vertically with reference to faceplate 1350. Gripper 1360 and gripper 1361 support walls 1301–1308. Similarly, grippers 1362–1363 support wall segments 1309–1316. Grippers 1364–1365 support wall segments 1317–1324 and grippers 1366–1367 support wall segments 1325–1332.

Another bonding method which may be used to bond walls or wall segments to the faceplate is anodic bonding. In an embodiment using an anodic bonding process, walls are formed of silicon and they are bonded directly to the glass surface of the faceplate. A high electric field is applied across the joint between the glass and the silicon wall. The wall is pressed against the glass and heat is applied. This combination of heat, pressure, and electric field causes the molecules of the materials to diffuse into each other so as to form a strong bond. The presence of the electric field reduces the heat and pressure required to form a bond, thereby easing the manufacturing process. Alternatively, an anodic bond may be formed between a wall and the surface of a faceplate when the surface is not glass and the wall is not silicon by coating the surface of the wall to be bonded with a suitable bonding material and applying an anodic bonding material to the faceplate. In one embodiment, the bottom surface of each wall is coated with silicon and glass frit is deposited over the surface of the faceplate and heat, pressure, and an electric field is applied so as to form an anodic bond. Alternatively, any combination of materials that will bond using an anodic bonding process may be used to form an anodic bond.

A wire bond connector may be attached to conductive segments formed on a spacer and attached to conductive lines or conductive regions on either a faceplate or on a backplate so as to make electrical contact between the conductive segments formed on the spacer and the faceplate or the backplate. In one embodiment, the wire bond connector is a short segment of wire formed of a conductive material.

Though the grippers, gripper segments, walls, and bonding structures of the present invention are shown to be disposed on the faceplate, they are also well suited to be disposed on the backplate. In addition, though walls, wall segments, grippers and gripper segments are shown to be running either horizontally or vertically, each embodiment may run either horizontally or vertically. Also, though electrical contact with wall segments is described with reference to contact with conductive lines located on the faceplate, electrical contact could also be made to a conductive region on the faceplate such as the anode area metal. The present invention is also well suited to providing contact between wall segments and a conductive region located on the backplate. In addition, slots formed by supporting structures such as grippers may be either slightly wider or narrower than the width of the wall or wall segment to be disposed therewithin.

Since the embodiments of the present invention shown in FIGS. 1–13 do not require feet, thus, in the embodiments shown in FIGS. 1–10B, the border requirement is greatly reduced, with a reduction in the order of one to ten millimeters. In the embodiments shown in FIGS. 11–14 which use wall segments, border requirements for walls are eliminated entirely. In addition, the expensive and costly steps of forming feet on each wall is eliminated, resulting in increased yield, increased throughput, and reduced cost of manufacturing.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. For example, though the present invention is described with reference to securing walls to a faceplate, the walls could also be attached to the backplate. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A flat panel display including a faceplate having an active area surface and a backplate having an active area surface, said faceplate attached to said backplate so as to define an active area peripherally surrounded by a border area, said flat panel display comprising:

a supporting structure disposed within said active area and extending across said active area, said supporting structure including a first gripper and a second gripper, said first gripper adjoining said second gripper so as to form a slot therebetween; and a plurality of wall segments coupled to said supporting structure, each of said wall segments having a length less than the length of said active area, said supporting structure mechanically restraining said wall segments within said slot so as to hold said wall segments such that said wall segments are oriented substantially perpendicular to said faceplate and substantially perpendicular to said backplate such that said wall segments maintain a relatively constant distance between said faceplate and said backplate.

* * * * *

UNITED STATES PATENT AND TRADEMARK OFFICE

CERTIFICATE OF CORRECTION

PATENT NO. : 6,356,013 B1 
DATED : March 12, 2002
INVENTOR(S) : Chungdee Pong, John D. Porter, Theodore S. Fahlen, Christopher J. Curtin, Robert G. Neimeyer and Paul N. Ludwig It is certified that error appears in the above-identified patent and that said Letters Patent is hereby corrected as shown below:

Title page,
Item [54], Title, should read --FLAT PANEL DISPLAY WITH WALL SEGMENTS --

Signed and Sealed this

Twenty-seventh Day of August, 2002

*Attest:*

*Attesting Officer*

JAMES E. ROGAN
*Director of the United States Patent and Trademark Office*